US011794236B2

(12) United States Patent
Busse et al.

(10) Patent No.: US 11,794,236 B2
(45) Date of Patent: Oct. 24, 2023

(54) CASTING CORE FOR CASTING MOLDS AND METHOD FOR THE PRODUCTION THEREOF

(71) Applicant: Fraunhofer-Gesellschaft zur Förderung der angewandten Forschung e.V., Munich (DE)

(72) Inventors: Matthias Busse, Bremen (DE); Christian Soltmann, Bremen (DE); Lukas Stumm, Bremen (DE); Franz-Josef Wöstmann, Bremen (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 85 days.

(21) Appl. No.: 17/277,712

(22) PCT Filed: Sep. 19, 2019

(86) PCT No.: PCT/EP2019/075153
§ 371 (c)(1),
(2) Date: Mar. 18, 2021

(87) PCT Pub. No.: WO2020/058393
PCT Pub. Date: Mar. 26, 2020

(65) Prior Publication Data

US 2021/0346943 A1 Nov. 11, 2021

(30) Foreign Application Priority Data

Sep. 19, 2018 (DE) ..... 10 2018 215 964.5

(51) Int. Cl.
*B22C 1/18* (2006.01)
*B22C 9/10* (2006.01)
*B22C 9/12* (2006.01)

(52) U.S. Cl.
CPC ..... *B22C 1/186* (2013.01); *B22C 9/106* (2013.01); *B22C 9/126* (2013.01)

(58) Field of Classification Search
CPC ..... B22C 1/186; B22C 9/10; B22C 9/106; B22C 9/126
See application file for complete search history.

(56) References Cited

U.S. PATENT DOCUMENTS

| | | | | |
|---|---|---|---|---|
| 3,898,090 | A * | 8/1975 | Clark | B22C 1/186 106/38.35 |
| 4,093,017 | A | 6/1978 | Miller, Jr. et al. | |
| 4,184,885 | A * | 1/1980 | Pasco | C04B 35/10 164/369 |
| 4,221,748 | A | 9/1980 | Pasco | |
| 2004/0084169 | A1 | 5/2004 | Roche et al. | |

FOREIGN PATENT DOCUMENTS

| | | | |
|---|---|---|---|
| DE | 1145310 | B | 3/1963 |
| DE | 2659168 | A1 | 7/1977 |
| DE | 60306068 | T2 | 6/2007 |
| DE | 102017107658 | A1 | 7/2018 |
| JP | 61-176439 | A | 8/1986 |

OTHER PUBLICATIONS

EPO machine translation of JP 61-176439 A (Year: 1985).*
International Search Report and Written Opinion received for PCT Patent Application No. PCT/EP2019/075153, dated Nov. 12, 2019, 18 pages. (8 pages of English Translation and 10 pages of Original Document).
S. Deville. "Freeze-Casting of Porous Ceramics: A Review of Current Achievements and Issues" Advanced Engineering Materials, vol. 10. No. 3. Mar. 1, 2008 (Mar. 1, 2008). pp. 155-169.

* cited by examiner

*Primary Examiner* — Kevin E Yoon
(74) *Attorney, Agent, or Firm* — Faegre Drinker Biddle & Reath LLP

(57) ABSTRACT

The present invention relates to a casting core for casting molds, wherein the casting core contains or consists of ceramic particles bound with a silica sol. The casting core has a pore structure, in which the average pore size of the pores increases at least in sections from the outside to the inside in the casting core. The present invention also relates to a method for producing the casting core according to the invention and to the use of the casting core according to the invention.

16 Claims, No Drawings

CASTING CORE FOR CASTING MOLDS AND METHOD FOR THE PRODUCTION THEREOF

CROSS REFERENCE TO RELATED APPLICATIONS

The present application is a national stage application of International Application No. PCT/EP2019/075153, filed Sep. 19, 2019, which claims priority to German Application No. DE102018215964.5, filed Sep. 19, 2018, the disclosures of which are hereby incorporated by reference in their entireties.

FIELD OF THE DISCLOSURE

The present invention relates to a casting core for casting molds, wherein the casting core contains or consists of ceramic particles bound with a silica sol. The casting core has a pore structure, in which the average pore size of the pores increases at least in sections from the outside to the inside in the casting core. The present invention also relates to a method for producing the casting core according to the invention and to the use of the casting core according to the invention.

BACKGROUND OF THE DISCLOSURE

Casting cores, or cores, are used when casting components in molds so that, whilst the mold is being filled, any cavities to be provided in the subsequent component are kept clear of casting material. To this end, the casting cores must have the necessary strength and must remain dimensionally stable during the casting process. Impregnation of the casting cores by the melt during the casting process at elevated pressure must be prevented. In order to achieve a good cast surface, additional requirements are placed on the core material. Here, minimal wetting between the melt and casting core and a smooth, chemically suitable surface are advantageous. Particularly in the case of casting molds for producing a complex inner shape, these must be able to be broken down well in order to ensure the removal of the core material from the component at the end of the casting process.

To produce casting molds, refractory fillers (for example silica sand, zircon sand, aluminosilicates, but also inorganic hollow spheres) comprising an organic (for example synthetic resins, protein binders) or inorganic binder (silicate binder, phosphate binder) are brought into the required form. This may be achieved by pressing, core shooting or casting. The surface of the cores may be improved by the application of washes. The thermal breakdown of the organic binder during the casting process weakens the core structure and enabler the removal of the core material from the cast piece, but is associated with the mission of environmentally harmful gases. Waterglass is often used as inorganic silicate binder. Waterglass may be solidified by a gassing with $CO_2$ or by the addition of esters or acids or by drying. Instead of waterglass, commercial silica sols may also be used and may be solidified by the same methods. In the case of inorganic binder systems, a good demoldability must also be ensured in addition to a sufficient core strength. The heat input must loosen the structure, and sintering must be prevented.

SUMMARY

On this basis, the object of the present invention is to provide a casting mold that on the one hand remains dimensionally stable during the casting process and on the other hand allows the cast component to be easily removed after the casting process.

This object is achieved in relation to a casting core by the features of the claims and in relation to a method for producing such a casting mold by the features of the claims. The claims also describe possible uses of the casting mold according to the invention. The claims also relate to advantageous refinements.

DETAILED DESCRIPTION

In accordance with the invention a casting core for casting molds is described, which casting core contains or consists of ceramic particles bound with a silica sol. The casting core has a pore structure, in which the average pore size of the pores increases at least in sections from the outside to the inside in the casting core.

The average pore size and/or the course of the average pore size within the casting core may be determined for example by means of mercury porosimetry and/or microscope images.

The silica sol is preferably a colloidal silica sol.

The present invention is characterized in particular in that the casting core has a pore structure in which the average pore size of the pores increases at least in sections from the outside to the inside in the casting core. Due to the smaller average pore size in the outer region of the casting core, the casting core has a dense and mechanically strong surface, which is suitable for the contact with the melt in the casting process, and therefore the casting mold remains dimensionally stable during the casting process. On account of the higher average pore size in the inner region of the casting core, the casting core, on the inside, has a very porous or unstable supporting structure, which facilitates the removal of the casting core after the casting process. The casting core according to the invention may therefore be removed easily from the cast component after the casting process. The casting core according to the invention therefore has a very advantageous hierarchical pore structure for the use in casting methods.

This advantageous pore structure may be achieved by a specific production method, which is based on the freeze gelation of ceramic suspensions. The use of silica sols as binder of the ceramic particles is of significant importance for this purpose. The silica sols may be transferred irreversibly into the gel state by freezing, such that the ceramic suspensions are prevented from melting once thawed. The sol-gel transition induced by freezing leads to a solidification of the material. The freezing front starts by cooling the mold surface at the casting core surface. The initially high freezing kinetics results in the formation of a dense structure with small pores at the surface of the casting core. With increasing distance from the casting core surface, the crystallization heat is dissipated more slowly, which gives the ice crystals more time to grow and results in the formation of increasingly larger pore channels. This core structure with a dense surface and large pore channels on the inside is ideally suited for the casting process and the subsequent removal of the core material from the casting body.

The sol-gel transition induced by freezing and the subsequent drying at elevated temperature is not associated with a significant change in volume or deformation. The inorganic binding under the thermal loading during the casting process does not lead to any harmful emissions or gas formation. The used core material may be used again as filler after comminution and classification.

In accordance with the invention the casting core has a pore structure, in which the average pore size of the pores increases at least in sections from the outside to the inside in the casting core. For example, the average pore size of the pores may therefore increase from the outer surface of the casting core to the center point of the casting core, preferably may increase continuously. In accordance with an alternative example, however, the pore size may also increase only in one or more portions between the outer surface and the center point of the casting core. In this case, it is possible in particular that the casting core is divided from the outside to the inside, or from the outer surface toward the center point, into a plurality of portions, for example a core center and at least one core shroud, wherein the pore size of the pores in each of the portions increases from the outside to the inside in the casting core. In this case, the pores of an outer region of a portion of the casting core arranged further inwardly may have a smaller average pore size than the pores of an inner region of a portion of the casting core arranged further outwardly.

The last-mentioned variant may be realized for example in that the casting core is produced in some sections from the inside to the outside by the aforementioned freeze gelation process.

A preferred embodiment of the casting core according to the invention is characterized in that the average pore size of the pores increases from the outside to the inside in the casting core and the average pore size of the pores in an outer region, preferably at an outer edge, of the casting core is 3 μm to 20 μm, preferably 3 μm to 8 μm, and/or the average pore size of the pores in an inner region, preferably at the center point, of the casting core is 100 μm to 1500 μm, preferably 100 μm to 1000 μm, particularly preferably 500 μm to 1000 μm. The outer region in this case is arranged further outwardly, i.e. at a further distance from the center point of the casting core, than the inner region. The average pore size may be determined for example by means of mercury porosimetry or microscopic images.

In a further preferred embodiment of the casting core according to the invention, the ceramic particles are inorganic ceramic particles which are preferably selected from the group consisting of mullite particles, zircon sand particles, silica sand particles, aluminosilicate particles, inorganic hollow spheres, aluminum oxide particles, and mixtures hereof.

In accordance with a further preferred embodiment, the ceramic particles have an average particle diameter of from 0.5 μm to 300 μm. The average particle diameter may be determined for example by means of laser refraction.

In a further preferred embodiment of the casting core according to the invention, the silica sol is selected from the group consisting of waterglass, colloidal nanosols and mixtures hereof. The silica sol may be sodium-, potassium- or lithium-stabilized. The silica sol is preferably a colloidal silica sol.

It is furthermore preferred that the silica sol is present in the form of particles with an average particle diameter of from 8 nm to 40 nm, preferably from 15 nm to 40 nm, particularly preferably from 20 nm to 40 nm. Sols with larger particles allow a higher solids content. The average particle diameter may be determined for example by means of laser refraction. Multimodal particle size distributions of the silica sol particles may increase the density of the ceramic structure.

A further preferred embodiment of the casting core according to the invention is characterized in that the casting core comprises a core center, which contains ceramic particles bound with a silica sol, and at least one core shroud which is arranged around the core center and which contains ceramic particles bound with a silica sol, wherein the core center has a pore structure in which the average pore size of the pores increases from the outside to the inside in the casting core, wherein the at least one core shroud in each case has a pore structure in which the average pore size of the pores increases from the outside to the inside in the casting core, and wherein the average pore size of the pores in an outer region, preferably an outer edge, of the core center is smaller than the average pore size of the pores in an inner region, preferably an inner edge, of the core shroud.

With a very large core volume, there is the risk on the inside of the casting core of the formation of cracks, since, when producing the casting core according to the invention by means of freeze gelation, the freezing rate decreases with increasing distance from the freezing surface and the size of the ice crystals forming during the freezing process increases. Very large ice crystals may promote the formation of cracks in the component. This may be prevented by a layered structure of the casting core. To this end, a partial volume is firstly cast and frozen from the middle of the core, i.e. the core center. Following the shaping, this inner core region, i.e. core center, is inserted into the core mold and is overmolded with an outer layer, i.e. the core shroud, and frozen. Excessive growth of the ice crystals is thus prevented. In this case, the casting core may also be constructed from more than two parts, i.e. From a core center and a plurality of core shrouds.

A casting core obtained in this way therefore has a core center and at least one core shroud, wherein it is true both for the core center and for each of the core shrouds that these each have a pore structure, in which the average pore size of the pores increases from the outside to the inside in the casting core. In other words, the core center has a pore structure in which the average pore size of its pores increases from the outside to the inside in the core center, wherein each of the core shrouds also each has a pore structure, in which the average pore size of its pores increases from the outside to the inside in the core shroud in question. The mentioned layered production additionally means that the average pore size of the pores in an outer region, for example an outer edge, of the core center is smaller than the average pore size of the pores in an inner region, for example an inner edge, of the core shroud or of one of the core shrouds.

A further preferred embodiment of the casting core according to the invention is characterized in that the average pore size of the pores in an outer region, preferably at an outer edge, of the core center and in an outer region, preferably at an outer edge, of the core shroud is 3 μm to 20 μm, preferably 3 μm to 8 μm, and/or the average pore size of the pores in an inner region, preferably at the center point, of the core center and in an inner region, preferably at an inner edge, of the core shroud is 100 μm to 1500 μm, preferably 500 μm to 1500 μm, particularly preferably 500 μm to 1000 μm. The average pore size may be determined for example by means of mercury porosimetry or microscopic images.

It is also preferred that:

- the composition of the core center differs from the composition of the core shroud, and/or
- the core shroud has a higher packing density than the core center, and/or
- the material of the ceramic particles contained in the core center differs from the material of the ceramic particles contained in the core shroud, and/or the average particle diameter of the ceramic particles contained in the core center differs from the average particle diameter of the ceramic particles contained in the core shroud.

The previously explained layered structure, i.e. a structure of the casting mold from a core center and at least one core shroud, additionally offers the advantage of being able to use freeze gelatable suspensions of different compositions, so that the core center and the core shroud or core shrouds consequently likewise have different compositions. For example, it is thus possible to obtain a denser structure for the outer layer, i.e. for the core shroud, which comes into contact with the melt, by means of a higher solids content and/or a higher packing density (adapted particle size distribution of the fillers). By contrast, for example, freeze gelatable suspensions with other filler particles, particle sizes or lower solids content may be used for the inner region of the core, i.e. the core center, so that a structure for example with a higher porosity and lower mechanical characteristic values is created after the consolidation. Different fillers may be selected for the outer core region, i.e. for the core shroud, than for the inner core region, i.e. for the core center. This may result in economic advantages, for example if costly materials (for example zircon sand, aluminosilicates) have to be used for the outer region and a low-cost filler (for example silica sand) may be selected for the inner region.

According to a further preferred embodiment, the casting core is infiltrated and/or coated with at least one wash and/or at least one reinforcing component. An even higher stability of the surface of the casting core is hereby achieved during the casting process.

The present invention additionally relates to a method for producing a casting core according to the invention in which:

a) at least one aqueous, ceramic suspension is produced, which comprises ceramic particles, a silica sol as binder, and water, b) the ceramic suspension is poured into a casting mold, which has the negative contour of the casting core to be produced or of part of the casting core to be produced, c) the ceramic suspension arranged in the casting mold is subjected to a cold treatment and in so doing is frozen, thus resulting in a solidification of the ceramic suspension to form a casting core or part of a casting core, d) the casting core or the part of the casting core in the frozen state is removed from the casting mold and is then dried.

In step a) an aqueous, ceramic suspension is thus firstly produced and comprises ceramic particles, a binder in the form of a silica sol, and water. The aqueous, ceramic suspension thus produced in step a) is poured in step b) into a casting mold, wherein this casting mold has the negative contour of the casting core that will be produced. In step c) the casting mold or the aqueous, ceramic suspension arranged in the casting mold is subjected to a cold treatment in which the aqueous, ceramic suspension is frozen, thus resulting in a solidification of the aqueous, ceramic suspension to form a casting core. With this freezing, the silica sols are transferred irreversibly into the gel state (freeze gelation), such that the ceramic suspensions are prevented from melting once the produced casting core has thawed. The sol-gel transition induced by freezing thus leads to a solidification of the material. In step d) the casting core in the frozen state obtained in step c) is lastly removed from the casting mold and is then dried. The sol-gel transition induced by freezing and the subsequent drying at elevated temperature is not associated with a significant change in volume or deformation. The inorganic binding under the thermal loading during the casting process does not lead to any harmful emissions or gas formation.

Due to this specific method based on freeze gelation, the particular pore structure of the casting core according to the invention may ultimately be obtained. During the freezing in step c), the freezing front starts by the cooling of the mold surface at the casting core surface. The initially high freezing kinetics results in the formation of a dense structure with small pores at the surface of the casting core. With increasing distance from the casting core surface, the crystallization heat is dissipated more slowly, which gives the ice crystals more time to grow and results in the formation of increasingly larger pore channels. This core structure with a dense surface and large pore channels on the inside is ideally suited for the casting process and the subsequent removal of the core material from the casting body.

In accordance with a preferred variant of the method according to the invention, during the cold treatment in step c), the ceramic suspension is cooled at a rate of 0.1 K/min to 15 K/min, preferably of 1 K/min to 10 K/min, particularly preferably of 3 K/min to 7 K/min, to a temperature≤−10 degrees Celsius, preferably to a temperature≤−20 degrees Celsius, very particularly preferably to a temperature≤−40 degrees Celsius.

In step a), substances that influence the crystallization behavior of the aqueous, ceramic suspension, for example what are known as cryoprotective substances (see U.S. Pat. No. 4,341,725, which is hereby incorporated by reference), may preferably be added to the aqueous, ceramic suspension.

The drying in step d) is preferably performed at a temperature of 50 degrees Celsius to 300 degrees Celsius, particularly preferably of 90 degrees Celsius to 200 degrees Celsius, and/or over a period of 0.1 to 10 hours, preferably of 0.5 to 5 hours, particularly preferably of 1 to 3 hours. The drying may be performed over a number of steps, wherein, for example, in the first drying step a low temperature is selected and in the second drying step a higher temperature is selected.

In a further preferred variant of the method according to the invention, the casting core is infiltrated and/or coated with at least one wash and/or at least one reinforcing component following step d).

A further preferred variant of the method according to the invention is characterized in that:

a) a plurality of aqueous, ceramic suspensions are produced, each comprising ceramic particles, a silica sol as binder, and water, b1) a first of the ceramic suspensions is poured into a first casting mold, which has the negative contour of a core center of the casting core to be produced, c1) the first ceramic suspension arranged in the first casting mold is subjected to a first cold treatment and in so doing is frozen, thus resulting in a solidification of the first ceramic suspension to form a core center of a casting core, d1) the core center of the casting core is removed from the first casting mold in the frozen state, b2) the core center of the casting core removed from the first casting mold is inserted into a second casting mold, which has the negative contour of the casting core to be produced or of part of the casting core to be produced, and then a second of the ceramic suspensions is poured into this second casting mold, c2) the second ceramic suspension arranged in the second casting mold is subjected to a second cold treatment and in so doing is frozen, thus resulting in a solidification of the second ceramic suspension to form a core shroud of the casting core or part of the core shroud of the casting core, d2) the casting core comprising the core center and the core shroud, or the part of the casting core comprising the core center and the part of the core shroud, is removed in the frozen state from the second casting mold and is then dried.

This specific method variant results in a layered structure of the casting core. In steps b1), c1) and d1), the core center of a casting core according to the invention is thus produced, and then a core shroud or a plurality of core shrouds of the casting core according to the invention is produced in steps b2), c2) and d2). Steps b1), c1), d1), b2), c2) and d2) are performed here in the above-mentioned order, i.e. step c1) comes after b1), step d1) comes after step c1), step b2) comes after step d1), step c2) comes after step b2), and step d2) comes after step c2). The suspensions produced in step a) do not all have to be produced simultaneously or directly one after the other. The suspensions produced in step a) (apart from the first suspension) also do not all have to be produced before step b1). The second suspension or the further suspensions in step a) may be produced at any time before step b2) or the corresponding step b), that is to say, for example, also only directly before step b2) or the corresponding step b).

As a result of this specific method variant of the layered structure, a casting core may thus be produced which comprises a core center, which contains ceramic particles bound with a silica sol, and at least one core shroud which is arranged around the core center and which contains ceramic particles bound with a silica sol, wherein the core center has a pore structure in which the average pore size of the pores increases from the outside to the inside in the casting core, wherein the at least one core shroud in each case has a pore structure in which the average pore size of the pores increases from the outside to the inside in the casting core, and wherein the average pore size of the pores in an outer region, preferably an outer edge, of the core center is smaller than the average pore size of the pores in an inner region, preferably an inner edge, of the core shroud.

With a very large core volume, there is the risk on the inside of the casting core of the formation of cracks, since, when producing the casting core according to the invention by means of freeze gelation, the freezing rate decreases with increasing distance from the freezing surface and the size of the ice crystals forming during the freezing process increases. Very large ice crystals may promote the formation of cracks in the component. This may be prevented by a layered structure of the casting core.

In accordance with a preferred variant of the method according to the invention, during the cold treatment in step c1) and/or step c2), the ceramic suspension is cooled at a rate of 0.1 K/min to 15 K/min, preferably of 1 K/min to 10 K/min, particularly preferably of 3 K/min to 7 K/min, to a temperature≤−10 degrees Celsius, preferably to a temperature≤−20 degrees Celsius, very particularly preferably to a temperature≤−40 degrees Celsius. The first cold treatment in step c2) may be the same cold treatment as the cold treatment in step c1) or a cold treatment different from the cold treatment in step c1).

According to a further preferred method variant, after step d2), steps b2), c2) and d2) are repeated at least once. If a casting core having more than one core shroud is produced, the method according to step d2) has further corresponding steps b), c) and d), i.e. steps b2), c2) and d2) are repeated. For example, the method with regard to the production of a casting core having two core shrouds may also comprise, after step d2), the corresponding steps b3), c3) and d3).

A further preferred method variant is characterized in that:

in step d1) the core center of the casting core is removed in the frozen state from the first casting mold and is then dried, and in step b2) the dried core center of the casting core is inserted into the second casting mold, or in step d1) the core center of the casting core is removed in the frozen state from the first casting mold, and in step b2) the still frozen core center of the casting core is inserted into the second casting mold.

The produced core center may thus be either dried or not dried after it is removed from the first casting mold, wherein in the former case the dried core center of the casting core in step b2) is inserted into the second casting mold, and wherein in the latter case the non-dried, still frozen core center of the casting core in step b2) is inserted into the second casting mold.

It is also preferred that:

the composition of the first ceramic suspension differs from the composition of the second ceramic suspension, and/or the second ceramic suspension has a higher solids content than the first ceramic suspension, and/or the second ceramic suspension has a higher packing density than the first ceramic suspension, and/or the material of the ceramic particles contained in the first ceramic suspension differs from the material of the ceramic particles contained in the second ceramic suspension, and/or the average particle diameter of the ceramic particles contained in the first ceramic suspension differs from the average particle diameter of the ceramic particles contained in the second ceramic suspension.

The casting core according to the invention is preferably producible or produced by the method according to the invention.

The present invention also relates to the use of the casting core according to the invention in a method for casting one or more components.

On the basis of the following examples, the present invention will be explained in more detail without wishing to restrict it to the specific embodiments and parameters shown here.

Exemplary Embodiment 1

46.7 percent mullite (Symulox M72 K0, Nabaltec, average particle size between 7-15 μm) and 20 percent aluminum oxide (CT 3000 SG, Almatis, average particle diameter 500 nm) were stirred into 33.3 percent sodium-stabilized silicon oxide nanosol (Nyacol 1440, Akzonobel, average particle diameter 14 nm, solids content 40 percent). The obtained homogeneous suspension is filled into a divisible mold made of silicone and is frozen at a freezing rate of 3 K/min to −40 degrees Celsius. The frozen component is demolded and placed in a divisible aluminum mold as core, so that the frozen component represents an inner volume component of the geometry formed by the aluminum mold. The above-described suspension is filled into the aluminum mold, and the inner, frozen component is thus overmolded. The aluminum mold is cooled at a rate of 7K/min to −40 degrees Celsius. The frozen component is removed from the mold and dried at 90 degrees Celsius.

Exemplary Embodiment 2

A suspension formed of 56.8 percent quartz powder (Siligran, Euroquarz, sieve fraction 63 μm) and 43.2 percent silica sol (Begosol K, Bego, particle size 8 nm) is produced and is frozen in a silicone mold at a rate of approximately 3K/min to −40 degrees Celsius. The frozen component is demolded and dried (after a first drying at 90 degrees Celsius the temperature is increased to 200 degrees Celsius and is maintained for two hours). The dried component cooled to room temperature is inserted into a divisible aluminum mold. A suspension formed of 75 percent mullite (Symulox M72 K0, Nabaltec, average particle size between 7-15 μm) and 25 percent silica sol (Nyacol 1440, Akzonobel, average particle diameter 14 nm, solids content 40 percent) is produced and is filled into the aluminum mold, and the dried component is thus overmolded. The aluminum mold is cooled at a rate of 7K/min to −40 degrees Celsius. The frozen component is removed from the mold and dried at 90 degrees Celsius.

The invention claimed is:

1. A casting core for casting molds, the casting core comprising ceramic particles bound with a silica sol, wherein the casting core has a pore structure comprising pores, and an average pore size of the pores increases at least in sections from an outside to an inside in the casting core: wherein the casting core comprises a core center, which contains ceramic particles bound with a silica sol, and at least one core shroud which is arranged around the core center and which contains ceramic particles bound with a silica sol, wherein the core center has a pore structure in which the average pore size of the pores increases from the outside to the inside in the casting core, wherein the at least one core shroud has a pore structure in which the average pore size of the pores increases from the outside to the inside in the casting core, and wherein the average pore size of the pores in an outer region of the core center is less than the average pore size of the pores in an inner region of the core shroud.

2. The casting core according to claim 1, wherein the average pore size of the pores increases from the outside to the inside in the casting core and at least one of (1) the average pore size of the pores in an outer region of the casting core is 3 μm to 20 μm, and (2) the average pore size of the pores in an inner region of the casting core is 100 μm to 1500 μm.

3. The casting core according to claim 1, wherein the ceramic particles are inorganic ceramic particles selected from a group consisting of mullite particles, zircon sand particles, silica sand particles, aluminosilicate particles, inorganic hollow spheres, aluminum oxide particles, and mixtures thereof.

4. The casting core according to claim 1, wherein the ceramic particles have an average particle diameter of from 0.5 μm to 300 μm.

5. The casting core according to claim 1, wherein the silica sol is selected from a group consisting of waterglass, colloidal nanosols and mixtures thereof.

6. The casting core according to claim 1, wherein the silica sol is present in a form of particles with an average particle diameter of from 8 nm to 40 nm.

7. The casting core according to claim 1, wherein at least one of (1) the average pore size of the pores in an outer region of the core center and in an outer region of the core shroud is 3 μm to 20 μm, and (2) the average pore size of the pores in an inner region of the core center and in an inner region of the core shroud is 100 μm to 1500 μm.

8. The casting core according to claim 1, wherein at least one of the following:

a composition of the core center differs from a composition of the core shroud;

the core shroud has a higher packing density than the core center;

a material of the ceramic particles contained in the core center differs from a material of the ceramic particles contained in the core shroud; and the average particle diameter of the ceramic particles contained in the core center differs from the average particle diameter of the ceramic particles contained in the core shroud.

9. The casting core according to claim 1, wherein the casting core is at least one of infiltrated and coated with at least one of (1) at least one wash; and (2) at least one reinforcing component.

10. A method for producing the casting core according to claim 1, the method comprising:

a) producing a plurality of aqueous, ceramic suspensions, each comprising ceramic particles, a silica sol as binder, and water;

b1) pouring a first of the produced aqueous, ceramic suspensions into a first casting mold having a negative contour of a core center of the casting core;

c1) subjecting the first of the produced aqueous, ceramic suspension arranged in the first casting mold to a first cold treatment, and thereby freezing and solidifying the first aqueous, ceramic suspension to form a core center of the casting core;

d1) removing the core center of the casting core in a frozen state from the first casting mold;

b2) inserting the core center of the casting core into a second casting mold having a negative contour of at least one portion of the casting core, and then pouring a second of the produced aqueous, ceramic suspensions into the second casting mold;

c2) subjecting the second of the produced aqueous, ceramic suspension arranged in the second casting mold to a second cold treatment, and thereby freezing and solidifying the second aqueous, ceramic suspension to form at least one portion of a core shroud of the casting core;

d2) removing the at least one portion of the casting core comprising the core center and the at least one portion of the core shroud in the frozen state from the second casting mold and then drying the at least one portion of the casting core comprising the core center and the at least one portion of the core shroud.

11. The method according to claim 10, wherein after step d2), steps b2), c2) and d2) are repeated at least once.

12. The method according to claim 10, wherein one of the following:

in step d1) the core center of the casting core is removed in the frozen state from the first casting mold and is then dried, and in step b2) the dried core center of the casting core is inserted into the second casting mold; and in step d1) the core center of the casting core is removed in the frozen state from the first casting mold, and in step b2) the frozen core center of the casting core is inserted into the second casting mold.

13. The method according to claim 10, wherein at least one of the following:

a composition of the first aqueous, ceramic suspension differs from a composition of the second aqueous, ceramic suspension;

the second aqueous, ceramic suspension has a higher solids content than the first aqueous, ceramic suspension;

the second aqueous, ceramic suspension has a higher packing density than the first aqueous, ceramic suspension;

a material of the ceramic particles of the first aqueous, ceramic suspension differs from a material of the ceramic particles of the second aqueous, ceramic suspension; and the average particle diameter of the ceramic particles of the first ceramic suspension differs from the average particle diameter of the ceramic particles of the second ceramic suspension.

14. The method according to claim 10, wherein at least one of (1) during the first cold treatment, the first aqueous, ceramic suspension is cooled at a rate of 0.1 K/min to 15 K/min to a temperature≤−10 degrees Celsius; and (2) during the second cold treatment, the second aqueous, ceramic suspension is cooled at a rate of 0.1 K/min to 15 K/min to a temperature≤−10 degrees Celsius.

15. The method according to claim 10, wherein the casting core is at least one of infiltrated and coated with at least one of (1) at least one wash and (2) at least one reinforcing component following step d2).

16. A method for casting one or more components comprising using the casting core according to claim 1.

* * * * *